United States Patent [19]

Shaffer

[11] Patent Number: 4,890,384

[45] Date of Patent: Jan. 2, 1990

[54] METHOD OF CRIMPING AN ELECTRICAL CONNECTION

[75] Inventor: Howard R. Shaffer, Millersburg, Pa.

[73] Assignee: AMP Incorporated, Harrisburg, Pa.

[21] Appl. No.: 297,817

[22] Filed: Jan. 13, 1989

Related U.S. Application Data

[60] Division of Ser. No. 237,684, Aug. 25, 1988, Pat. No. 4,828,516, which is a continuation of Ser. No. 567,024, Dec. 30, 1983, abandoned.

[51] Int. Cl.[4] ..... H01R 43/00

[52] U.S. Cl. ..... 29/863; 439/877

[58] Field of Search ..... 29/863, 751, 753; 72/416, 410; 439/877

[56] References Cited

U.S. PATENT DOCUMENTS

| | | | |
|---|---|---|---|
| 1,858,418 | 9/1930 | Rowley | 140/113 |
| 2,034,090 | 5/1934 | Douglas | 173/269 |
| 2,226,849 | 7/1936 | Douglas | 173/269 |
| 2,359,083 | 8/1942 | Carlson . | |
| 2,535,013 | 3/1946 | Freedom | 173/269 |
| 2,693,216 | 10/1951 | Kerchner et al. | 153/1 |
| 2,816,276 | 1/1957 | Fuller et al. | 339/276 |
| 2,906,017 | 9/1959 | Badeau | 29/518 |
| 2,952,174 | 12/1960 | Broske | 81/15 |
| 2,965,147 | 7/1961 | Hoffman | 153/1 |
| 3,028,776 | 6/1962 | Keller et al. | 81/15 |
| 3,067,489 | 12/1962 | Hoffman | 29/155.55 |
| 3,098,517 | 3/1963 | Zell et al. | 153/1 |
| 3,146,519 | 9/1964 | Redwine | 29/155.55 |
| 3,175,281 | 3/1965 | Elfsten | 78/410 |
| 3,833,993 | 9/1974 | Kremlrau | 29/203 D |
| 4,080,731 | 8/1978 | Hammond | 29/863 |
| 4,120,556 | 10/1978 | Waldron et al. . | |
| 4,261,194 | 4/1981 | Stephens | 72/402 |

FOREIGN PATENT DOCUMENTS 2474771 7/1981 France .

OTHER PUBLICATIONS

AMP Incorporated, Publication No. IS7P04 dated 2/16/77, pp. 1–4.

AMP Incorporated, Publication No. AI 2645 dated 1/18/80, pp. 1–9.

*Primary Examiner*—Howard N. Goldberg

*Assistant Examiner*—Irene Cuda

*Attorney, Agent, or Firm*—Anton P. Ness

[57] ABSTRACT

An electrical connection of a terminal contact to an electrical conductor is crimped by applying compressive force to the right and left sides of the barrel of the contact but not at the center and not applying it directly toward the center, thus forming an "oblique" crimp. Such an oblique crimp can be formed using a punch die and an opposing anvil die each having a crimping surface with a central recessed relief area whereby the crimping surface does not compress the center of the contact barrel. On each side of the relief area is a substantial diagonal portion of the crimping surface, and outward therefrom is a transverse shoulder, both of which engage the contact barrel during crimping. This crimping is especially useful for contacts having closed or seamless barrel walls and also especially for crimping a slightly oversized barrel to a many-stranded conductor without an intermediate sleeve, and it is particularly useful where confined crimping is required. The use of only two opposing dies more economically and efficiently enables fully automated feeding and terminating procedure; the dies can also be used in a manual crimping tool.

9 Claims, 3 Drawing Sheets

METHOD OF CRIMPING AN ELECTRICAL CONNECTION

This application is a divisional of application Ser. No. 07/237,684 filed Aug. 25, 1988, now U.S. Pat. No. 4,828,516, which was a continuation of application Ser. No. 06/567,024 filed Dec. 30, 1983 now abandoned.

FIELD OF THE INVENTION

This invention relates to electrical connections comprising electrical conductors with terminal contacts attached thereon and more particularly, to an improved crimp for electrical connections and to methods and means for the formation thereof.

BACKGROUND OF THE INVENTION

In the formation of electrical connections it has been customary to strip insulating material from the end of an electrical conductor, then to enclose the stripped wire ends in an electrically conductive metal ferrule or barrel to which a terminal contact or some other conductive member is or can be connected. Compression force is then applied to the barrel to press and permanently deform it into an electrically conductive and mechanically strong connection with the wire ends contained therein, known as crimping. It is also known to enclose the metal barrel in a sleeve or shell of insulating material prior to or after crimping.

There have been numerous approaches to the applying of the compression force, beginning with a simple flattening, or a dimpling. Most approaches use a pair of opposing dies, sometimes one of which is called a punch and the other an anvil. The shape of the dies or one of them has been varied to provide a crimped connection having a distinct cross-sectional shape; for instance, see U.S. Pat. No. 3,098,517 (oval shape), U.S. Pat. No. 2,359,083 (diamond shape), and U.S. Pat. No. 2,693,216 ("W" shape).

More complex crimping has been used, such as is disclosed in U.S. Pat. No. 2,816,276 where several crimp indentations are applied to the same connection by separate dies at different locations around the circumference of the barrel, each being distinctly skewed to partially wrap around the barrel. A single but progressive crimp is disclosed in U.S. Pat. No. 2,952,174. Crimping force may be applied from three directions around the barrel as in U.S. Pat. No. 2,965,147.

A particularly effective crimp which has been popular for many years is formed by four crimping dies disposed 90° to each other, each of which indents the electrical connection directly towards the center of the connection, all simultaneously, to form a four-indent crimp such as illustrated in U.S. Pat. Nos. 4,120,556 and 2,226,849. When an appropriate size of barrel is used with a particular size of conductor, such a four-indent crimp gives excellent electrical engagement among the wires and between the metal barrel and wires, and also gives excellent mechanical engagement and particularly good resistance to torsional stress or twisting because of the four indented areas and four lobes.

The main objective of crimping is to form an intimate electrically-conductive connection of the wire ends to the metal barrel in a manner which is also strong enough mechanically so that the barrel is firmly attached to the wires to resist being inadvertently pulled off.

The primary deficiencies in crimping are that the wire ends can be broken or otherwise damaged if too much compression force is used, or that the wire ends may have spaces between themselves and the barrel, or among themselves or both if enough compression force is not used or is not applied at the optimum location or locations around the circumference of the barrel. Another deficiency in crimping is that substantial axial elongation could occur in the connection; that is, when the metal of the barrel and/or the wires is compressed greatly enough, it flows along the axis of the connection towards the terminal and towards the wire cable. This is especially undesirable in power conductors.

Also, another drawback can be that during the crimping the metal of the barrel may flow through a gap between the lateral edges of the dies as they close toward each other; or localized thinning of the barrel wall may occur, and particularly in thin-walled barrels even shearing of the wall could possibly occur.

A further important consideration is that a seemingly successful crimp which remedies all the deficiencies stated above and achieves high electrical conductivity and mechanical strength and excellent resistance to torsional and tensile stress and to atmospheric corrosion of the barrel and the wire ends, may not be easily or economically adaptable to mass production techniques because more than two dies are required for a single crimping operation. It is highly desirable to utilize fully automated crimping machines (or terminators) having automated feeding of terminals and wire ends to be connected and crimped. Some successful crimps are presently only appliable by the use of hand tools, and some others require manual feeding in semi-automatic production.

In selecting a terminal contact for any particular size of electrical conductor, it would be preferable to select that contact having a barrel size just large enough for the stripped wire ends of the conductor to be inserted without individual outer strands snagging the end of the barrel wall, fraying and not entering inside the barrel. To use a barrel which has an inner diameter much larger than the thickness of the stripped conductor would mean that there would be excessive space between the barrel wall and the wires which would have to be eliminated to obtain a crimped electrical connection having satisfactory mechanical engagement and good electrical conductivity. But to have one size of barrel for each size of conductor presents a serious inventory problem also considering the various kinds of terminal contacts, and it is commonly accepted practice to use one barrel size for two adjacent conductor sizes, such as a No. 8 size barrel for both No. 8 and No. 10 sizes of conductors. A No. 8 size barrel matches a No. 8 size conductor, but is oversized for a smaller No. 10 conductor. To overcome this oversize problem, sometimes an intermediate metal sleeve is placed around the wire ends and inside the barrel. Without such a sleeve standard crimping techniques including the four-indent crimp do not provide a satisfactory crimp especially for a many-stranded conductor, because significant voids and spaces remain either among the wire ends, or between them and the barrel wall.

It is one objective of this invention to achieve a crimp which presses stripped wire ends into an optimum level of electrically conductive engagement with a metal barrel and which provides a sound mechanical connection between the wire ends and the barrel so that no disengagement due to tensile strain occurs during normal handling and under normal service conditions for the contact termnal.

It is another objective that a cross-sectional geometry of the crimped connection be obtained which reduces the effects of torsional stress or twisting upon the wire with respect to the connection (which if the wire would be allowed to turn would tend to wedge or cam open the crimp in the barrel) during normal handling and under normal service conditions for the contact terminal, which could lead to degrading of the electrical conductivity or even to mechanical disengagement of the wire from the barrel.

It is yet another objective of this invention to minimize voids or air spaces in the crimped connection to enhance its corrosion resistance and reduce localized overheating and loss of power, while minimizing axial elongation in the connection, and does not break or otherwise damage the individual wire ends.

It is a further objective of this invention not to create thin areas in the barrel wall, nor shear or otherwise damage the barrel or its plated surface.

It is further objective of this invention to provide a method of crimping whereby a successful crimp of a relatively oversized barrel to a conductor can be easily obtained without placing an intermediate sleeve therebetween.

It is yet a further objective to provide a successful confined crimp, that is, confining the sides of the connection during crimping to a width not larger than the original outer diameter of the barrel.

It is a further important objective of the invention to provide a crimp which satisfies all of the above objectives and lends itself more to being easily and economically applied by means of a fully automated terminal and wire feed and crimping apparatus by requiring only two opposing dies.

SUMMARY OF THE INVENTION

A crimp is provided for an electrical connection of a terminal contact with an electrical conductor which is made using a punch die and an opposing anvil die both having particular matching crimping surface configurations including relief areas centrally thereof, and the dies coact in a confined crimping procedure to create four spaced smooth indented areas which divide the cross section of the crimped connection into opposing relatively arcuate lobes and opposing relatively box-shaped lobes. The crimp is an oblique crimp because the crimping force is applied to the connection on the right and left sides thereof, but not in the central portion directly radially to the connection, because the relief areas substantially do not engage the connection during crimping. Said crimp achieves excellent properties and is adaptable to an automated production process. Dies are provided which can be inserted into automatic crimping apparatus, and can also be placed into a manual tool. The use of the two opposing dies disposed vertically also allows for automated side feed of terminated contacts to be crimped. Both single strand and multi-strand conductors can be crimped using the dies of the present invention. Also, a satisfactory crimp can be obtained between a conductor and a relatively oversized barrel without using an intermediate sleeve.

DETAILED DESCRIPTION OF PREFERRED EMBODIMENTS

Figure 1:
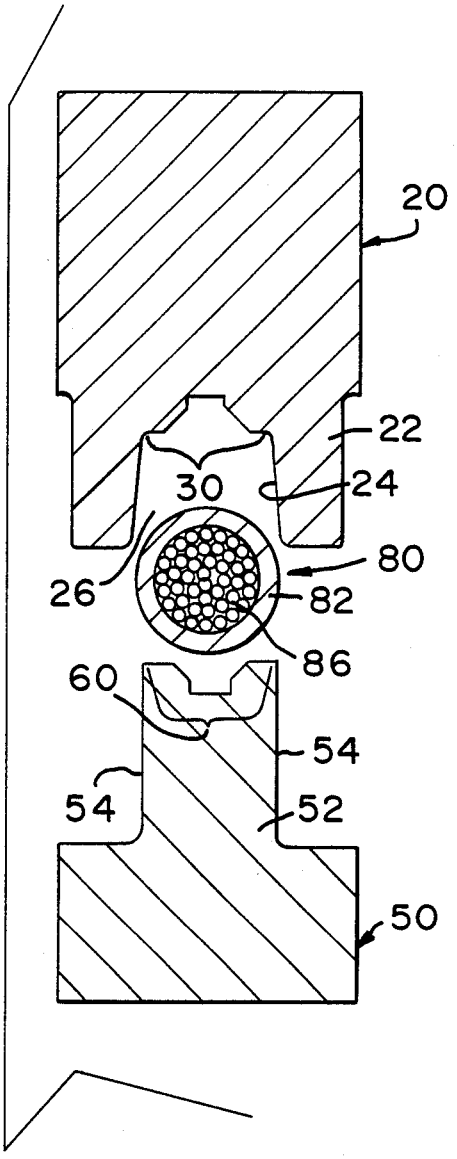
FIG. 1 is a cross-sectional view of the punch die and anvil die spaced from each other with a terminal barrel around a conductor to be crimped thereto therebetween.

FIG. 1 shows an upper or punch die 20 and a lower or anvil die 50 of conventional high carbon steel or like metal in spaced relation to each other vertically to move vertically relative to each other during crimping. (For convenience punch die 20 will be referred to as being vertically above anvil die 50 and the compression force will be said to be applied thereby to an electrical connection vertically from the top and bottom.) Punch die 20 has confining walls 22 having confining wall surfaces 24 which serve to confine the electrical connection laterally within recess 26 during crimping thereof. Extending from one confining wall surface 24 to the other at the roof of recess 26 and transverse of the crimping direction is punch crimping surface 30. Anvil die 50 has an anvil portion 52 with vertical wall surfaces 54 which are dimensioned to fit closely within confining walls 22 of punch die 20 as the punch die and anvil die converge during crimping to make an electrical connection. Extending across the top of anvil portion 52 and transverse of the crimping direction is anvil crimping surface 60. An uncrimped electrical connection 80 is shown placed between punch die 20 and anvil die 50.

Figure 2:
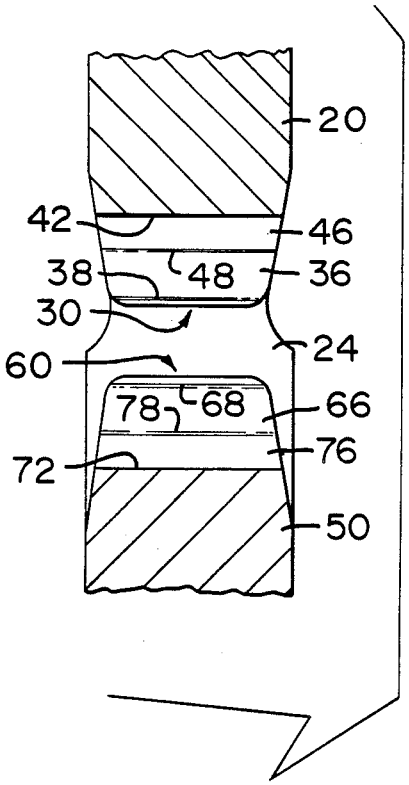
FIG. 2 is a cross-sectional view of the punch and anvil dies of FIG. 1 at the centers thereof orthogonal to FIG. 1.

FIG. 2 illustrates a cross section of punch die 20 and anvil die 50 of FIG. 1 spaced apart (without electrical connection 80 therebetween), which is a view toward either side from the centers of the crimping surfaces 30 and 60. One confining wall surface 24 of punch die 20 can be seen.

Figure 3:
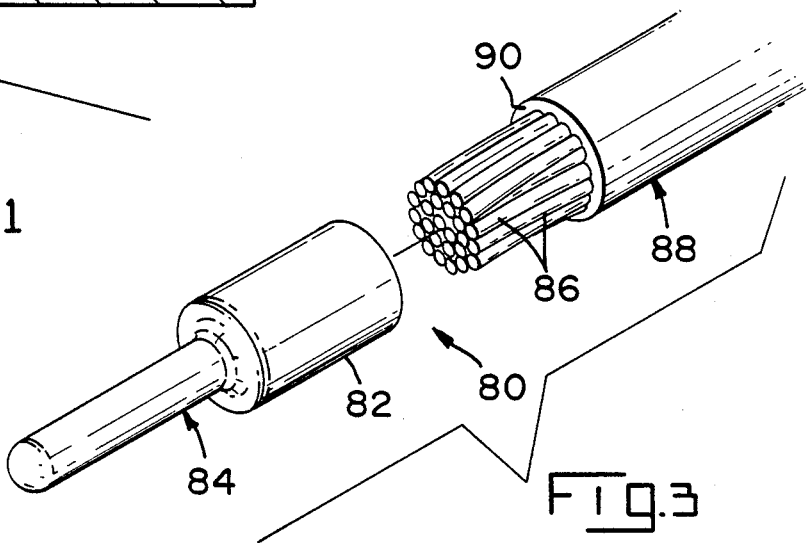
FIG. 3 is a perspective view of a terminal pin contact with wire ends of a cable exploded therefrom.

As shown in FIG. 3 electrical connection 80 has a metal barrel 82 of a terminal pin contact 84 and end portions of wire strands 86 of a multi-strand electrical conductor cable 88 with the insulation 90 removed therefrom. Metal barrel 82 is of the closed, seamless type.

During the crimping operation the connection 80 is placed on anvil crimping surface 60 and centered thereon, and punch die 20 aligned with anvil die 50 is moved relatively towards anvil die 50 under a preselected compressive force. The anvil portion 52 with connection 80 thereon moves relatively into recess 26; and upon such movement metal barrel 82 of terminal 84 is compressed and crimped onto wire strands 86 positioned in barrel 82. During at least the final stages of the crimping operation, electrical connection 80 is intended to be completely circumferentially confined by punch crimping surface 30, confining wall surfaces 24, and anvil crimping surface 60. The compressive force must exceed the flow stress of the metal of connection 80, which is the stress required to cause plastic deformation. Under such compression the metal of the connection tends to flow or be extruded either inward, or into those areas of the cross-section where it is not confined against extrusion at any particular point in time during the crimping operation, or longitudinally along the axis of the connection.

Figure 4:
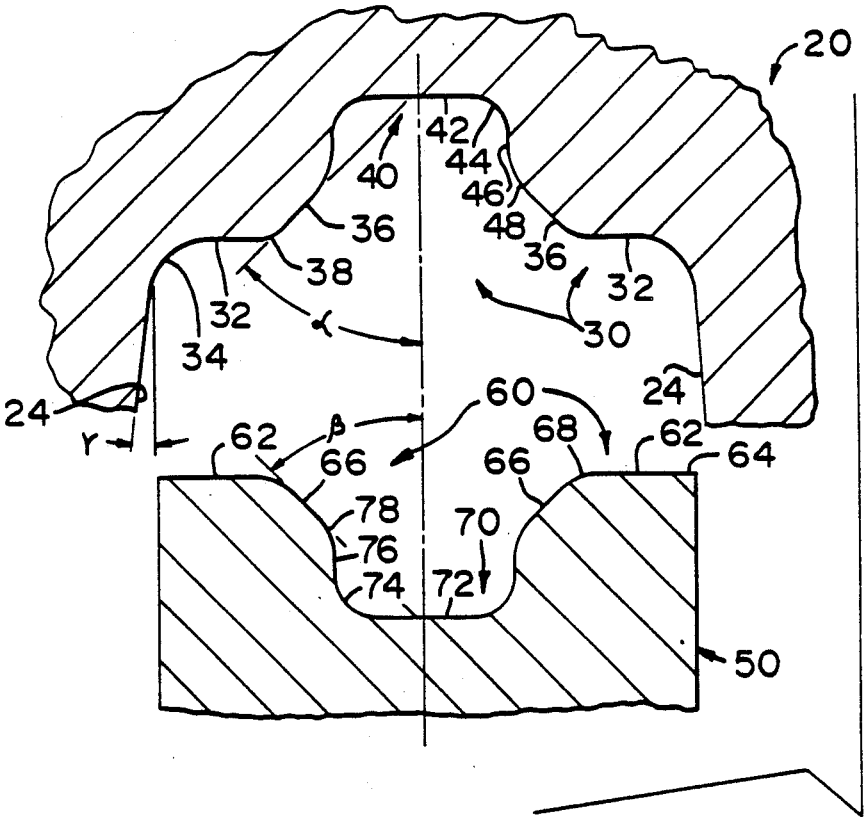
FIG. 4 is a cross-sectional view of the crimping surfaces of the punch die and anvil die of FIG. 1 spaced from each other.

It can be seen most clearly in FIG. 4 that confining wall surfaces 24 are at a small angle $\gamma$ to the vertical. This greatly facilitates the removal of the crimped electrical connection from recess 26. The small angle $\gamma$ can range up to 10° but in the embodiment shown in FIG. 2 actually is 5°.

As is illustrated in FIG. 4, each of punch crimping surface 30 and anvil crimping surface 60 is substantially symmetrical about its center, and each has a particular geometric shape which is substantially the mirror-image or converse of the other. On the far right and far left sides of punch crimping surface 30 are punch shoulders 32 which are horizontally aligned with each other. Punch shoulders 32 are smoothly faired into confining wall surfaces 24 forming rounded wall corners 34, and extend substantially horizontally towards each other a short distance. Disposed in the middle of each side of punch crimping surface 30 is a punch diagonal surface 36 which has a generally diagonal attitude upward and toward the center of punch crimping surface 30. Each punch diagonal surface 36 comprises roughly about the central one-half of its side of punch crimping surface 30. These punch diagonal surfaces 36 are preferably smooth and substantially flat and disposed at an angle $\alpha$ from the vertical which angle $\alpha$ can have a range of from about 30° to about 60° and is shown in the embodiment of FIG. 4 as being 45°. At the intersection of each punch diagonal surface 36 with its adjacent punch shoulder 32 is a smoothly rounded edge 38. Disposed between punch diagonal surfaces 36 is a recessed relief area 40 having a substantially flat relief surface 42, relief corners 44, relief area sides 46 and rounded edges 48 where relief area sides 46 are smoothly faired into punch diagonal surfaces 36. Recessed relief area 40 may have a width of from about 25% to 40% of the total width of punch crimping surface 30 but is preferred to have a width of about one-third the width of the punch crimping surface 30, and its depth may be equal to about one-fourth or more its own width. The depth may be greater but should be at least great enough so that relief surface 42 does not compress the connection during crimping.

Similarly, on the far right and far left sides of anvil crimping surface 60 are anvil shoulders 62 which are substantially flat and are horizontally aligned with each other, each disposed opposite from a corresponding punch shoulder 32. Anvil shoulders 62 intersect associated vertical wall surfaces 54 of anvil die 50 at preferably squared corner edges 64. Disposed in the middle of each side of anvil crimping surface 60 is an anvil diagonal surface 66 comprising roughly about the central one-half of its side of anvil crimping surface 60 and which is smooth and substantially flat and at an angle $\beta$ from the vertical which angle $\beta$ can have a range of from about 30° to about 60° and is shown in the embodiment of FIG. 4 as being 45°. At the intersection of each anvil diagonal surface 66 with its adjacent anvil shoulder 62 is a smoothly rounded edge 68. Disposed between anvil diagonal surfaces 66 is a recessed relief area 70 having a substantially flat relief surface 72, relief corners 74, relief area sides 76 and rounded edges 78 where relief area sides 76 are smoothly faired into anvil diagonal surfaces 66. The width and depth of relief area 70 of anvil die 50 is preferably the same as relief area 40 of punch die 20.

Because of recessed relief areas 40 and 70 and diagonal surfaces 36 and 66, the compressive force is applied on each side of the electrical connection 80 from above and below and not directly on the middle portion radially or towards the center of the connection 80. The crimping force can be said to be applied by the crimping surfaces 30 to the connection 80 when opposing pairs of barrel-engaging die portions, which are spaced apart horizontally to "straddle" the barrel, engage associated pairs of barrel sections on both sides of barrel 82 and apply force at an angle to the outer surfaces thereof. Since the compression force is not applied radially by the dies to the connection 80, it can be said to be applied obliquely and the resulting crimp can be termed an oblique crimp. Generally, force is applied vertically from above and below to the right one-third and left one-third of the connection 80 but not the central one-third.

As can be seen most clearly in FIG. 4, except for corner edges 64 of anvil die 40 all corners of both punch crimping surface 30 and anvil crimping surface 60 are rounded so that there are no surface discontinuities from one side to the other along either surface.

The wall of metal barrel 82 is compressed at four angularly spaced sections associated in pairs inwardly into wire strands 86, which begin to compress against themselves. As wire strands 86 compress they deform and begin eliminating the voids and spaces located among themselves, and between themselves and the wall of metal barrel 82, eventually attaining irregular polygonal shapes with substantially flat sides adjoining adjacent wires as they are pressed tightly together into a substantially integral condition.

During the last stages of the crimping operation punch die 20 and anvil die 50 are stopped a distance from each other, which distance is termed the crimp height and is selected by the operator prior to crimping. In the examples discussed herein, this is measured from punch relief surface 42 to anvil relief surface 72. At this final point in the crimping operation punch shoulders 32, anvil shoulders 62 and confining walls 22 generally form a box-like shape, and the crimped electrical connection has been formed into this box-like shape on its right side and its left side.

Figure 5:
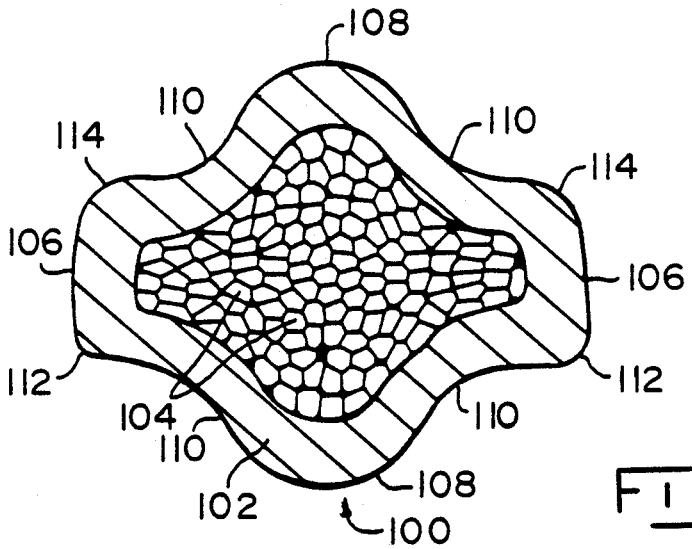
FIG. 5 is a cross-sectional view of a crimped multi-strand electrical connection using the dies of FIG. 1.

FIG. 5 illustrates the cross-section of a multi-strand electrical connection 100 which has been crimped using the punch and anvil dies of the present invention. A pin terminal contact was selected, made of a conventional $\frac{1}{4}$ (one-quarter)-hard brass and having an annealed seamless barrel with an inner diameter of 0.182 inches, an outer barrel diameter of 0.231 inches and a barrel wall thickness of 0.025 inches. This contract was crimped to a stripped No. 8 AWG insulated conductor cable having 136 strands of silver-plated copper wire. Punch and anvil dies were selected having an overall crimping surface width of 0.218 inches, a relief width of about 0.07 inches and relief depth of about 0.022 inches, and a crimp height of 0.177 inches; the dies had a crimping length of about 0.095 inches. Each of relief corners 44 and 74 and rounded edges 48 and 78 had a radius of 0.02 inches, and each of wall corners 34 and smoothly rounded edges 38 and 68 had a radius of 0.025 inches. A compression force of 1,650 psi was used, in a five-ton conventional bench press.

In crimped connection 100 of FIG. 5 crimped barrel wall 102 contains crimped wires 104. Connection 100 has generally box-like right and left lobes 106, upper and lower generally arcuate lobes 108, and four indent areas 110, and is no wider than the original outer diameter of the barrel. Because of the confining wall surfaces 24 being at a slight angle $\gamma$, as shown in FIG. 4 to assist in removal of the crimped connection from the punch die 20, the left and right sides of barrel wall 102 are slightly sloped at the same angle downward and outward along confining wall surfaces 24 and towards the very small gaps which exist between the confining wall surfaces 24 and associated corner edges 64 of anvil crimping surface 60. However, by using an anvil die, properly dimensioned to fit well with the punch die and by selection of a prope crimp height between punch and anvil dies 20 and 50 at the completion of the crimping operation, flow by metal barrel wall 102 into the gaps does not occur and the crimp has been optimally "confined". A somewhat distinct lower corner 112 occurs on each side of crimped connection 100, but upper corners 114 remain more generally rounded.

In FIG. 5 it can be observed that no flares of metal barrel wall 102 occurred; no noticeable thin areas of the wall were produced; and connection 100 did not undergo the amount of deformation needed to go beyond merely approaching or reaching relief surfaces 42 and 72 or relief sides 46 and 76; those portions of connection 100 which extended into the relief areas remained arcuate instead of conforming to the shape of the relief areas. Very few minor isolated voids or spaces remained within barrel wall 102. Some axial elongation occurred in crimped connection 100 shown in FIG. 4; a calculation was made wherein the total (barrel wall plus wires) metal cross-sectional area was calculated after the crimp to be 86% compared with the metal cross-sectional area of the connection at the same location prior to crimping meaning that only a 14% deformation was obtained, considered to be a very good result.

The effect of right and left lobes 106, upper and lower lobes 108 and the four indent areas 110 in FIG. 5 is to provide high resistance to torsional stress; wires 104 are not likely to turn within barrel wall 102 which would have resulted in a weakened connection. Also, in multi-strand connection 100, from point to point along the crimp length, wires 104 are twisted resulting from the original manufacture of the conductor cable itself which cooperates with the tight packing thereof and the shape of the crimp in resisting torque.

Figure 6:
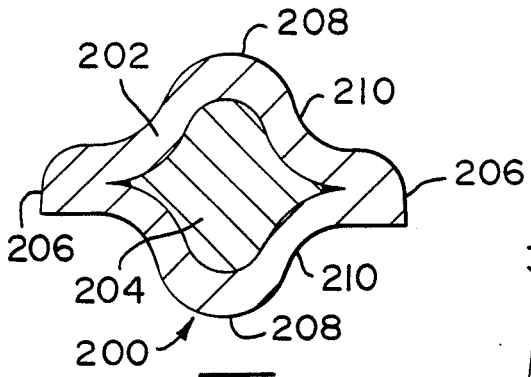
FIG. 6 is a cross-sectional view of a crimped single-wire connection using the dies of FIG. 1.

The crimping dies of the present invention can be used successfully with a single or solid strand electrical connection 200. As illustrated in FIG. 6, a good crimped connection can be obtained whereby the single wire 204 is adjacent and conforms to the deformed shape of barrel wall 202 having box-like lobes 206, arcuate lobes 208 and four indent areas 210. A smaller crimp height setting was used, and box-like lobes 206 are thinner than those of connection 100.

Figure 7:
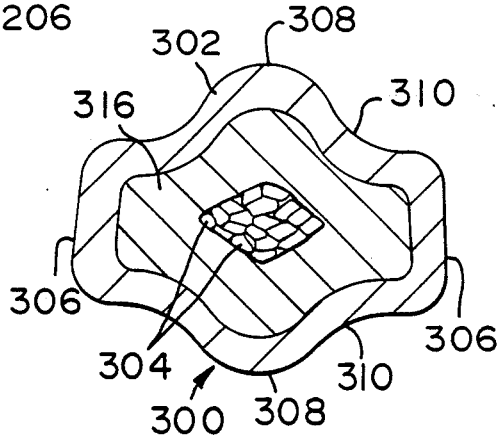
FIG. 7 is a cross-sectional view of a multi-strand electrical connection using an oversized barrel and an intermediate sleeve, crimped using the dies of FIG. 1.

FIG. 7 illustrates a cross-section of a crimped electrical connection 300 where a slightly oversized barrel (compared to the thickness of the conductor) was used and an intermediate metal sleeve 316 had been placed in the gap between wire strands 304 and barrel wall 302 prior to crimping. The same dies were used as described for connection 100 of FIG. 5 under the same compressive forces and using the same crimp height, for a smaller No. 10 AWG cable but using an identical pin terminal contact of ¼-hard brass with an annealed seamless barrel having the same size as that of connection 100 (a No. 8 barrel). The outer barrel diameter was 0.231, the inner barrel diameter was 0.182 inches and the wall thickness was 0.025 inches. No. 10 AWG cable was selected having 19 strands of silver-plated copper wire. The punch and anvil dies had an overall crimping surface width of 0.218 inches, a relief width of about 0.07 inches and relief depth of 0.022 inches, and a crimping length of about 0.095 inches; a crimping height of 0.177 inches was selected, and the compression force was 1,650 psi. An intermediate sleeve of leaded copper was selected and placed between wire strands 304 and barrel wall 302; the outer diameter of the intermediate sleeve was 0.173 inches, its inner diameter 0.136 inches and its thickness 0.018 inches.

In crimped connection 300 it can be observed that the effective wall thickness (barrel wall 302 plus intermediate wall 316) is greater than the wall thickness of connection 100 of FIG. 5; and that while well-packed none of wire strands 304 are found in box-like lobes 306 or arcuate lobes 308. However, a satisfactory crimped connection was obtained.

Figure 8:
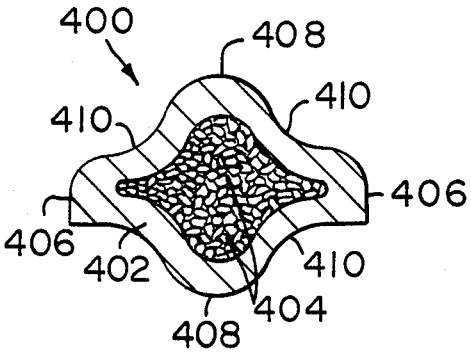
FIG. 8 is a cross-sectional view of a multi-strand electrical connection using an oversized barrel without an intermediate sleeve, crimped using the dies of FIG. 1.

By comparison to crimped connection 300 of FIG. 7 utilizing an intermediate sleeve between a No. 10 AWG conductor and oversized (No. 8) barrel, FIG. 8 illustrates a crimped connection 400 of a 136-strand No. 10 AWG conductor with an oversized No. 8 barrel without an intermediate sleeve, with the same punch and anvil dies and compressive force, except that a smaller crimp height of 0.157 inches was selected. Wire strands 404 were tightly packed into not only arcuate lobes 408 but also box-like lobes 406, which were thinner than box-like lobes 306 of connection 300 or lobes 106 of connection 100 which were formed with a greater crimp height setting of 0.177 inches. No thin areas of barrel wall 402 were produced in indent areas 410 or elsewhere. A highly satisfactory crimp was obtained.

Figure 9:
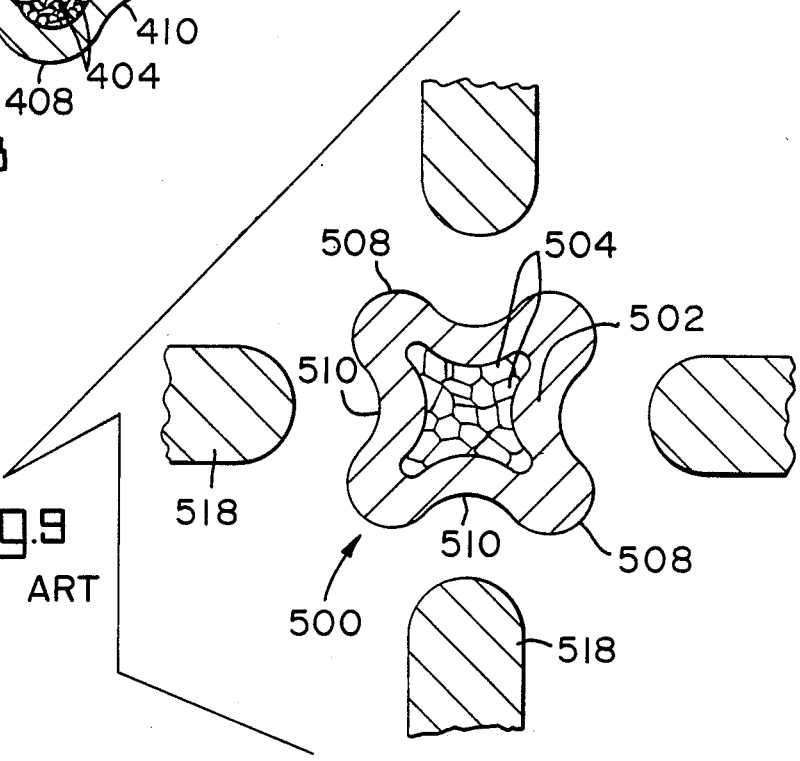
FIG.9 PRIOR ART
FIG. 9 prior art is a cross-sectional view of a typical four-indent crimped electrical connection.

FIG. 9 generally illustrates a typical four-indent crimped connection 500 of the prior art, having four lobes 508 and four indent areas 510 formed by four coacting indentor dies 518 (shown spaced therefrom) each indenting connection 500 radially, approaching the center. Precise alignment of the dies and connection 500 is needed. Wire strands 504 of a 19-strand cable are shown.

With the particular shape of the crimping surfaces of the present invention which apply the compression force over a generally large surface area of the connection but not in the center thereof, using proper-sized dies for the particular barrel and associated conductor being crimped, and using an appropriately selected crimp height and compression force, and the crimping surfaces preferably being smooth and having rounded corners, localized stress on the wall of the metal barrel of the connection is low and there is little tendency towards creating localized thinning of the wall of the metal barrel which would be highly undesirable. It is also important that an appropriate size of barrel is selected for the particular diameter of capable being terminated.

When the dies are placed in a hand tool for a manual crimping operation, a hand tool such as Hand Crimping Tool 90337-1 from AMP Incorporated may be used, generally following the instructions accompanying that product.

The oblique crimp of the present invention can be applied on various types of terminal contacts, not just the pin terminal type of the example. It is also preferred that the oblique crimp be used on closed barrel terminals which are seamless (or have a welded seam); but it is believed that this crimp would also be used satisfactorily on barrels having an abutting seam.

Further, it is believed that while the examples shown and discussed herein are directed towards confined crimps where it is important to limit the width of the crimped connection, the oblique crimp of the present invention is believed to be useful for crimps where confinement is not required.

This oblique crimp may be especially used on a many-stranded conductor with a slightly oversized barrel such as a No. 8 barrel with a No. 10 AWG wire conductor without using an intermediate sleeve, where a standard four-indent crimp such as that shown in FIG. 9 commonly would not eliminate voids and spaces in that portion of the lobes adjacent the barrel wall but instead leaves the wires in those lobe portions somewhat loose and uncompressed.

Because the punch and anvil dies of the present invention crimp a connection from only two opposing directions, above and below, and then retract, or the punch die retracts upward releasing the crimped connector, automated side feed of connectors maybe used whereby the connectors are continuously fed on a tape or other continuous feed strip. Such side feed automated devices are known such as the AMP-O-LECTRIC brand side feed stripper-crimper machine (trademark of AMP Incorporated) used in conjunction with the AMP-O-LECTRIC brand terminating machine trademark of AMP Incorporated).

Although only one embodiment of the crimping dies of the invention has been illustrated and described herein, it is to be especially understood that various changes, such as in the relative dimensions, shapes and angles of the dies, the materials used, and the suggested use of the dies, may be made therein without departing from the spirit and scope of the invention as will now be apparent to those skilled in the art.

I claim:

1. A method for crimping a contact terminal having a wire-receiving barrel to an electrical conductor having a stripped portion disposed within the barrel, to form an electrical connection, comprising:

placing said wire-receiving barrel of said terminal to be crimped to said stripped portion of said electrical conductor contained therewithin, between a pair of opposing crimping dies secured in a crimping apparatus and aligned with respect to each other along an axis and movable relative to each other along said axis to within a preselected distance from each other, which crimping dies each have a crimping surface disposed transverse to said axis and containing a central recessed relief area between two barrel-engaging portions spaced apart to straddle said wire-receiving barrel, the barrel-engaging portions of the crimping dies being arranged in adjacent opposing pairs associated with respective pairs of barrel sections on both sides of said wire-rceiving barrel;

applying a predetermined compressive force with said crimping dies to said wire-receiving barrel of said terminal containing said portion of said conductor and to outer surfaces of said pairs of barrel sections on both sides of said terminal from above and below thereof and obliquely at an angle to said outer barrel section surfaces, thus deforming one of each of said pairs of barrel sections directly toward the respective other of said pair and indirectly against and into said wire portion at four angularly spaced locations forming four indentations in said wire portion, thereby directly deforming the portions of said wire-receiving barrel between said barrel section pairs and indirectly deforming said wire portion to flow toward other sections of said wire-receiving barrel, whereby substantially the entire wire portion has been subjected to deformation forming an assured termination, and removing said crimped connection from said dies.

2. The method of claim 1 wherein one of said opposing dies includes wall sections extending in the direction of said crimping axis from both sides of said crimping surface thereof, whereby said one die is adapted to receive said wire barrel portion thereinto and the other said die partially thereinto between said wall sections, and said electrical connection is confined during crimping thereof.

3. The method of claim 1 wherein an intermediate sleeve is placed between said terminal contact and said conductor prior to crimping.

4. The method of claim 1 wherein a terminal contact to be crimped to an electrical conductor has a barrel which is slightly oversized relative to said conductor and no intermediate sleeve is placed therebetween.

5. The method of claim 1 wherein said crimping apparatus is a manual tool.

6. The method of claim 1 wherein said crimping apparatus is an automated machine.

7. The method of claim 1 wherein said placing of said terminal between said crimping dies is performed manually.

8. The method of claim 1 wherein said placing of said terminal between said crimping dies is performed by machine.

9. The method of claim 1 wherein said placing of said terminal between said crimping dies is performed as part of a continuous automated feed process.

* * * * *